United States Patent [19]

Stephens

[11] 4,073,264

[45] Feb. 14, 1978

[54] DEVICE FOR IMPREGNATING PAPER

[76] Inventor: Ronald M. Stephens, 305-1400 Camosun, Victoria, British Columbia, Canada, V8V 4L4

[21] Appl. No.: 770,240

[22] Filed: Feb. 18, 1977

[51] Int. Cl.[2] ..... B05C 1/02

[52] U.S. Cl. ..... 118/250

[58] Field of Search ..... 118/249, 250, 252; 68/202

[56] References Cited

U.S. PATENT DOCUMENTS

| | | | |
|---|---|---|---|
| 432,606 | 7/1890 | Dawson | 118/250 |
| 1,341,311 | 5/1920 | Glines | 118/250 X |
| 1,902,264 | 3/1933 | Rector | 118/250 |
| 2,503,694 | 4/1950 | Voorhies | 118/249 |

*Primary Examiner*—John P. McIntosh
*Attorney, Agent, or Firm*—Seed, Berry, Vernon & Baynham

[57] ABSTRACT

A novelty device is disclosed for impregnating paper currency. The currency is fed into the slot of a housing having a lower reservoir holding an impregnating solution. A roller contacts the solution and transfers a portion of the solution to the paper passing between the roller and opposing driven roller. The opposed driven roller is driven by hand.

7 Claims, 3 Drawing Figures

DEVICE FOR IMPREGNATING PAPER

BACKGROUND OF THE INVENTION

Field of the Invention

This invention relates to a device for impregnating paper currency.

SUMMARY OF THE INVENTION

It is a prime object of this invention to provde a device for impregnating or coating paper which is hand operated and of a unique and functional design.

This is accomplished by a device having a reservoir holding a quantity of impregnating solution in the lower portion thereof, a first roller having a resilient material covering its periphery rotatably mounted in the lower portion of the housing to contact the solution, the resilient material absorbing or coated with a quantity of the solution, a second roller directly opposed to the first roller mounted in the upper portion of the housing and contacting the first roller for driving the first roller. The housing is designed so that the currency can be fed through a slot into which the two opposed rollers extend. The second roller is driven by a circular plate of considerably greater diameter rotatably mounted in the upper portion of the housing and engaging the second roller. Idler rollers rotatably mounted in the upper portion of the housing are spaced about the circular plate and engage the outer periphery of the plate to support the plate for rotation. The plate is rotated by hand.

DESCRIPTION OF THE PREFERRED EMBOIDMENTS

Figure 1:
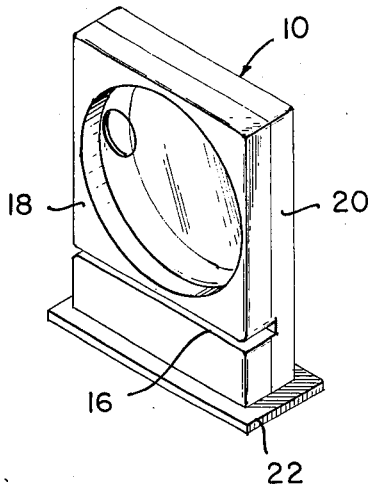
FIG. 1 is a perspective view of the device of this invention.
Figure 2:
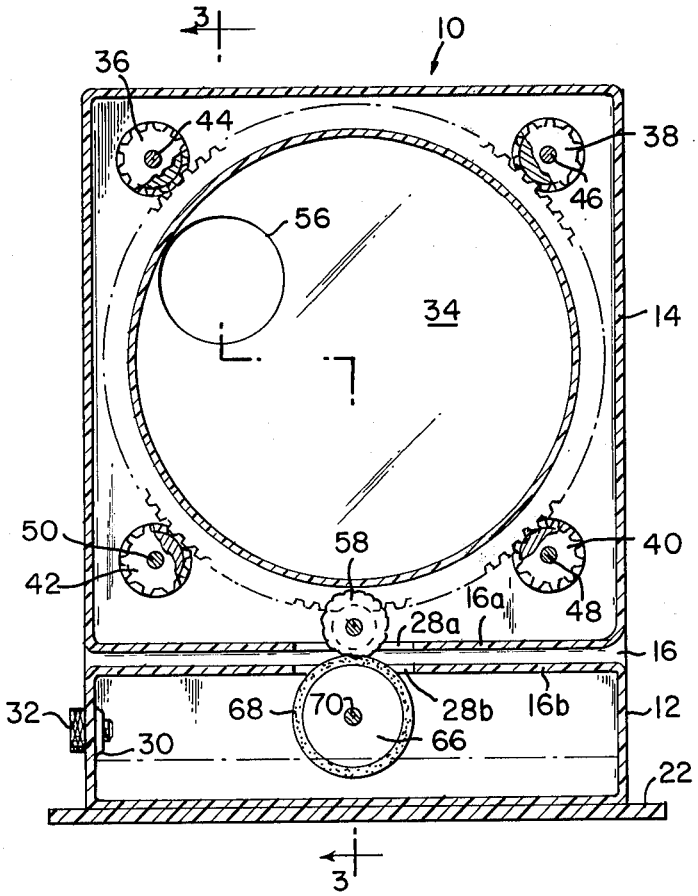
FIG. 2 is a cross-sectional view of FIG. 1 along section line 2—2 of FIG. 3.

Referring to FIG. 1, the novelty device illustrated includes a rectangular housing 10 fabricated from a suitable plastic material or any other suitable material, although the configuration of the device as illustrated is rectangular, it may be any shape desired. The housing 10 is divided into a lower portion 12 and an upper portion 14 by a slot 16 having a lower surface **16*b* forming the top of a reservoir and an upper surface 16*a* forming the bottom wall of the upper portion of the housing. The housing is also divided into a front half 18 and a rear half 20 of identical structure except that the rear half is not bisected by the slot 16. A suitable base 22 is secured to the bottom wall of the lower portion of the housing 10. The upper portion of the housing 14 on both the front half 18 and rear half 20 contain a central opening 24 having a diameter almost equal to the height and width of the upper portion of the housing. The top wall 16*a* and bottom wall 16*b* have openings 28 and 28*b* intermediate the end walls of the housing to accommodate opposed rollers whose function will be described. The lower portion of the housing functions as a reservoir for holding a quantity of impregnating solution. Access to the interior of the reservoir is through an opening 30 secured by a cap 32**.

Figure 3:
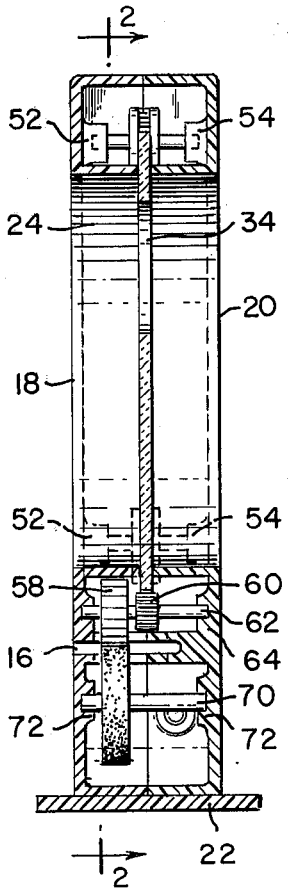
FIG. 3 is a cross-sectional view of FIG. 2 along section line 3—3 of FIG. 2.

A transparent circular plate 34 having a toothed periphery is supported in the central opening 24 of the upper portion of the housing 10 for rotation by four idler rollers 36, 38, 40 and 42 positioned at the respective corners of the upper portion of the housing. Each of the idler rollers is mounted on its respective shaft 44, 46, 48 and 50 with each shaft journaled for rotation to integral supports 52 and 54 extending inwardly from the housing wall as illustrated in FIG. 3. The transparent plate 34 includes a circular opening 56 therein of lesser diameter than plate 34, the opening large enough for a person to engage a finger therein for rotation of the circular plate.

Rotation of the transparent plate 34 drives corrugated wheel or roller 58 through gear 60, both secured to shaft 62 journaled in place to inwardly directed supports 64 integral with the front and rear sections of the housing. The corrugated wheel is mounted so as to extend through opening **28*a* into the slot 16 and engage wheel 66 having a resilient covering 68 thereon. The wheel 66 is mounted on a shaft 70 journaled for rotation to inwardly directed supports 72 extending inwardly from the front and rear sections of the housing. The wheel 66** is mounted directly opposite the corrugated wheel and in driven contact therewith.

Paper currency is impregnated with a perfumed scent or other solution by placing the currency in the slot against the opposed rollers 58 and 66 and then manually turning the transparent plate 34 by engaging a finger in the opening 56 thereof.

The device is a novelty device which is attractive and of unique design.

The embodiment of the invention in which a particular property or privilege is claimed is defined as follows:

1. A device for impregnating paper comprising:

a reservoir holding an impregnating solution, a housing having a slot extending the width thereof and separating the housing into an upper and lower portion, the lower portion of the housing forming said reservoir for the impregnating solution, a first roller having a resilient material covering the periphery thereof rotatably mounted in the lower portion of the housing so as to contact the solution, a portion of the periphery of the roller extending into the slot, a second roller mounted directly opposite the first roller rotatably mounted in the upper portion of the housing with a portion of its periphery extending into the slot and engaging and driving the first roller, a circular plate of considerably greater diameter than the second roller rotatably mounted in the upper portion of the housing having means to drive the second roller, idler rollers rotatably mounted in the upper portion of the housing and spaced about and engaging the periphery of the circular plate to support the circular plate for rotation, and means for manually engaging the circular plate for rotation thereof.

2. The device of claim 1 wherein the second roller has a corrugated peripheral surface for gripping paper fed between the first and second rollers.

3. The device of claim 1 wherein the upper portion of the housing has a circular opening slightly smaller in diameter than the circular plate, the circular plate positioned in the opening and sandwiched between the front and rear walls of the upper portion of the housing, the idler rollers also rotatably mounted between the front and rear wall of the upper portion of the housing and supporting the circular plate for rotation.

4. The device of claim 1 wherein the means for manually engaging the circular plate for rotation is an opening therein.

5. The device of claim 1 wherein the housing comprises mating forward and rearward sections and wherein the slot formed in the forward section of the housing extends the width thereof and separates the housing into an upper portion and a lower portion.

6. The device of claim 1 wherein the circular plate is a transparent material.

7. A device for impregnating paper comprising:

a housing having a slot extending the width thereof and separating the housing into an upper portion and a lower portion with the lower portion forming a reservoir holding an impregnating solution and the upper portion including a circular opening therein approximately the width of the upper portion of the housing, a first roller having a material covering its periphery rotatably mounted in the lower portion of the housing to contact the impregnating solution, a portion of the periphery of the first roller extending into the slot, a second roller directly opposite the first roller rotatably mounted in the upper portion of the housing extending into the slot and engaging the first roller for driving thereof, a transparent circular plate of considerably greater diameter than the second roller sandwiched between front and rear walls of the upper portion of the housing and driving the second roller, idler rollers rotatably mounted in the upper portion of the housing spaced about the periphery of the circular plate and engaging the circular plate to support same for rotation, and an opening in the circular plate for manually engaging the circular plate for rotation.

* * * * *